US011458755B2

(12) United States Patent
Speer et al.

(10) Patent No.: US 11,458,755 B2
(45) Date of Patent: Oct. 4, 2022

(54) PRINTING PROCESS FOR TRANSFERRING A PRINTING SUBSTANCE

(71) Applicant: FERRO GMBH, Frankfurt am Main (DE)

(72) Inventors: Dietrich Speer, Langenselbold (DE); Alexander Zeig, Heppenheim (DE)

(73) Assignee: FERRO GmbH, Frankfurt am Main (DE)

( * ) Notice: Subject to any disclaimer, the term of this patent is extended or adjusted under 35 U.S.C. 154(b) by 48 days.

(21) Appl. No.: 16/971,921

(22) PCT Filed: Feb. 15, 2019

(86) PCT No.: PCT/EP2019/053900

§ 371 (c)(1),
(2) Date: Aug. 21, 2020

(87) PCT Pub. No.: WO2019/162212

PCT Pub. Date: Aug. 29, 2019

(65) Prior Publication Data

US 2021/0086541 A1 Mar. 25, 2021

(30) Foreign Application Priority Data

Feb. 22, 2018 (DE) ..... 10 2018 104 059.8

(51) Int. Cl.
*B41M 5/00* (2006.01)
*B41M 5/395* (2006.01)
(Continued)

(52) U.S. Cl.
CPC ..... *B41M 5/0052* (2013.01); *B41M 5/007* (2013.01); *B41M 5/0058* (2013.01);
(Continued)

(58) Field of Classification Search
CPC ..... B41M 5/0052; B41M 5/0058; B41M 5/0064; B41M 5/007; B41M 5/395;
(Continued)

(56) References Cited

U.S. PATENT DOCUMENTS

2002/0076636 A1* 6/2002 Uchida ..... G03G 9/09733 430/108.4
2005/0024458 A1* 2/2005 Sanada ..... B41J 2/211 347/100

(Continued)

FOREIGN PATENT DOCUMENTS

DE 19746174 C1 7/1999
DE 10051850 A1 10/2001

(Continued)

OTHER PUBLICATIONS

International Search Report for PCT/EP2019/053900 dated Jun. 4, 2019.

(Continued)

*Primary Examiner* — Yaovi M Ameh
(74) *Attorney, Agent, or Firm* — Rankin, Hill & Clark LLP; Christopher Jan Korff

(57) ABSTRACT

The present invention relates to a printing method for transferring printing substance from an ink carrier to a substrate, in which the printing substance undergoes a change in volume and/or position with the aid of an energy-emitting device that emits energy during a process time in the form of electromagnetic waves wherein the printing substance comprises a high molecular weight binder. In addition, the present invention describes a printing substance for carrying out the method and the use thereof.

20 Claims, 5 Drawing Sheets

(51) Int. Cl.
*B41M 5/382* (2006.01)
*B41M 5/46* (2006.01)

(52) U.S. Cl.
CPC ..... *B41M 5/0064* (2013.01); *B41M 5/395* (2013.01); *B41M 5/0076* (2013.01); *B41M 5/38257* (2013.01); *B41M 5/46* (2013.01); *B41M 2205/02* (2013.01); *B41M 2205/08* (2013.01); *B41M 2205/30* (2013.01)

(58) Field of Classification Search
CPC .. B41M 5/0076; B41M 5/38257; B41M 5/46; B41M 2205/02; B41M 2205/08; B41M 2205/30
See application file for complete search history.

(56) References Cited

U.S. PATENT DOCUMENTS

| | | | | |
|---|---|---|---|---|
| 2005/0212888 | A1 | 9/2005 | Lehmann | |
| 2007/0116904 | A1* | 5/2007 | Sen | B41M 5/52 428/32.34 |
| 2012/0164777 | A1 | 6/2012 | Kleine Jaeger | |
| 2016/0167400 | A1* | 6/2016 | Ruiz Vega | B41M 5/007 347/102 |

FOREIGN PATENT DOCUMENTS

| | | | | | |
|---|---|---|---|---|---|
| DE | 10210146 | A1 | | 9/2003 | |
| EP | 0 530 018 | A1 | | 3/1993 | |
| GB | 2 007 162 | A | | 5/1979 | |
| JP | H07230184 | A | * | 8/1995 | G03G 9/087 |
| JP | H-1120327 | A | | 1/1999 | |
| JP | 2009-083116 | A | | 4/2009 | |
| JP | 2009-083117 | A | | 4/2009 | |
| WO | 2014/083028 | A1 | | 6/2014 | |

OTHER PUBLICATIONS

Espacenet Bibliographic data for DE10210146 published Sep. 25, 2003, 2 pages.
Espacenet Bibliographic data for DE19746174 published Jul. 8, 1999, 2 pages.
Espacenet Bibliographic data for DE10051850 published Oct. 11, 2001,1 page.
Espacenet Bibliographic data for JPH11-20327 published Jan. 26, 1999, 1 page.
Espacenet Bibliographic data for JP2009-083116 published Apr. 23, 2009, 1 page.
Espacenet Bibliographic data for JP2009-083117 published Apr. 23, 2009, 1 page.

* cited by examiner

PRINTING PROCESS FOR TRANSFERRING A PRINTING SUBSTANCE

The present invention relates to a printing process for the transfer of a printing substance from an ink carrier onto a substrate as well as a printing substance to carry out the process.

A printing method is primarily understood to be a method for duplicating text and/or image templates as often as required, this duplication previously taking place by means of a printing form that was re-inked after each printing. This method is also used today when copying large numbers of items. In general, a distinction is made between four fundamentally different printing processes. On the one hand, the letterpress process is known in which the printing elements of the printing form are raised, while the non-printing parts are recessed. This includes, for example, letterpress and so-called flexography or high pressure aniline dye printing. Furthermore, planographic printing processes are known in which the printing elements and the non-printing parts of the printing form are essentially in one plane. This includes, for example, offset printing, in which, strictly speaking, the inked drawing on the printing plate is not printed directly on the substrate, but is first transferred to a rubber cylinder or cloth and only then printed on the substrate. When printing material is mentioned below, however it is to be understood as both the actual printing material, that is to say the material to be printed, and any transmission medium, such as e.g. a rubber cylinder. A third process is the so-called gravure printing process, in which the printing elements of the printing form are recessed. An industrially used gravure printing process is what is known as doctor blade gravure. Finally, a print-through process is also known in which the ink is transferred to the substrate through screen-like openings in the printing form at the locations to be printed.

These printing processes are all characterized by the fact that they require a printing form that is more or less complex, so that these printing processes only work economically for very large print runs, usually well over 1000 pieces.

For printing short runs, printers are already used, which are often connected to an electronic data processing system. These generally use digitally controllable printing systems that are able to print individual printing dots as required. Such printing systems use various processes with different printing substances on different printing materials. Some examples of digitally controllable printing systems are: laser printers, thermal printers and inkjet printers. Digital printing processes are characterized by the fact that they do not require printing forms.

For example, from GB 20 07 162 an electrothermal ink printing process is known in which the water-based ink is briefly heated to boiling in a suitable ink nozzle by electrical impulses, so that a gas bubble develops in a flash and an ink drop from the nozzle is shot out. This process is generally known under the term "bubble jet". These thermal ink printing processes, in turn, have the disadvantage that, on the one hand, they consume a great deal of energy for printing a single printing dot and, on the other hand, are only suitable for water-based printing processes that are water-based. In addition, each individual print point must be controlled separately with the nozzle. Piezoelectric ink printing processes, on the other hand, suffer from the disadvantage that the nozzles required for them easily clog so that only very special and expensive inks can be used for this.

Furthermore, the documents US 2012/0164777 A1 and US 2016/0167 400 A1 disclose printing inks which can be used in printing processes in which, for example, the printing ink applied to a carrier is transferred to a substrate by a laser beam. However, these publications do not disclose any compositions which comprise high molecular weight binders; in particular, no molecular weight information is given in relation to the polymers disclosed in a long list. Furthermore, the printing processes are not described in more detail, with printing processes being known in particular from the document EP 0 530 018A1 in which the printing inks are applied to a solid film applied and detached from this. In this case, the printing inks are in a solid phase, so that the carrier on which the printing ink is applied has to be completely replaced after a printing process. US 2016/0167400 A1 sets out very high viscosities for the printing inks, so that it is only suitable for processes in which the carrier must be completely replaced after each use. Instructions for a printing process in which ink is continuously applied to a flexible belt or a roller and transferred from this carrier to a substrate to be printed are not found in the publications US 2012/0164777 A1 and US 2016/0167 400 A1 The document EP 0 530 018 A1 describes a melt transfer process in which the printing inks are melted so that they have a very high viscosity at room temperature, the ink-containing layer comprising a binder as the main component, which has a softening point in the range of 50 up to 160° C. and is solid or semi-solid (cf. EP 0 530 018 A1, page 4, lines 51 to 55).

From DE 197 46 174 it is known that a laser beam induces a process through very short pulses in a printing substance located in the cells of a printing roller, so that the printing substance undergoes a change in volume and/or position. As a result, the printing substance grows over the surface of the printing form and the transfer of a printing dot to a printing material that is approaching it is possible. However, this method has the disadvantage that it is very difficult to fill the cells due to the small cell diameter. It is therefore proposed in DE 100 51 850 to apply the printing substance essentially forming a continuous film to the ink carrier. The energy can either be transferred directly into the printing substance or first to an absorption layer applied to the ink carrier, which in turn then transfers the energy to the printing substance. In the first case, special printing substances must be used that are able to absorb the energy. This severely limits the variety of printing inks that can be used. In addition, the light is absorbed in the printing ink within a relatively large volume that the laser beam passes through. In addition, with some colors the energy is not completely absorbed. The absorption is also strongly dependent on the printing substance used and the thickness of the printing substance on the ink carrier. Due to the relatively large volume in which the energy is absorbed, a relatively large amount of energy must be introduced into the printing substance in order to induce the change in volume and/or position of the printing substance that is necessary for setting a printing dot. In addition, there is often a delay in boiling, so that the temperature at which gas bubbles form in the printing substance cannot be predicted. As a result, the absorption—and the associated local heating of the printing substance—takes place largely in an uncontrolled manner, which, inter alia, results in a large variation in the print dot size. In order to ensure that the desired printing dot is set in every case, significantly more energy must therefore be introduced into the printing substance than is normally necessary to induce the desired change in position and/or volume of the printing substance.

Furthermore, a generic printing method is set out in DE 102 10 146 A1. In this case, printing inks, as previously set out in DE 197 46 174 or DE 100 51 850, are heated by a laser beam and thereby transferred from an ink carrier to a printing material. In the process described here, absorption bodies are used in order to improve the process.

The methods set out above, for example in DE 197 46 174, DE 100 51 850 or DE 102 10 146, solve the economic problems set out above for various printing methods that exist with a small number of copies to be reproduced or the difficulty that the ink printing methods set out above, only very special inks can be used, which must not have a high solids content, in particular no larger particles. However, the print quality is not sufficient for certain requirements, since a clear formation of smaller droplets is visible in the vicinity of the intended print points (satellite formation). This problem is not only visually undesirable, but also limits the minimum distance between printed lines that are generated, for example, when printing silver-containing inks for the production of conductive traces, since otherwise short circuits can occur. It also limits the minimum size of bar codes and other machine-readable characters.

In view of the state of the art, it is the object of the present invention to provide a printing method which leads to a higher contour definition, but is also suitable for small printing runs. In particular, it should be possible to obtain color-fast decorations, and to process glass colors or inks for electronic circuits. Furthermore, the method should be able to be carried out as simply and inexpensively as possible. The properties of the printed decorations or conductor tracks should not be adversely affected. The coating should exhibit the highest possible adhesion to various materials. Furthermore, the decoration that can be obtained by the method should have a high definition.

These and other problems that are not explicitly mentioned, which can, however, be readily derived or inferred from the context discussed in the introduction, are achieved by a printing method with all the features of claim 1. Appropriate modifications of the printing process according to the invention are protected in subclaims 2 to 6. With regard to the printing substance, the subjects of claims 6 to 18 provide a solution to the underlying problem.

The present invention relates to a printing method for transferring printing substance from an ink carrier to a substrate, in which the printing substance experiences a change in volume and/or position with the help of an energy-emitting device that emits energy during a process time in the form of electromagnetic waves is characterized in that the printing substance comprises a high molecular weight binder.

Through this design a decoration can be produced in very high quality and cost-effectively for smaller print runs in a simple manner, wherein the substrate is not particularly limited.

Surprising advantages result in particular in the areas of automobile glass, flat glass for interior and exterior decoration, barcodes and also silver conductive traces. In this case, in particular, small print runs can be obtained inexpensively, with spare parts in particular also being able to be provided efficiently, so that storage costs can be reduced.

Furthermore, in comparison to the state of the art set out above, in particular the screen printing technique, in which inorganic materials can be used in their usual grain size distributions, no sieve storage is required, so that further cost and organizational advantages are provided, since a storage of a sieve is not necessary. Furthermore, the printing system can be operated with a very short set-up time, with the design being capable of complete transfer into the printing system from a computer, which can be set up remotely. Furthermore, designs on a PC can be changed as required, so that very individualized designs are also possible. Due to relatively low additional costs, the market share of individual designs can be increased. Since printing is digital, any pattern and serialization or individualization of the individual printed substrates are possible.

In addition, inorganic materials can be used in their usual particle size distributions without the need for a complex fine grinding process as in the conventional ink-jet process. There the particles must be in the range <1 μm. The pigments are damaged by the grinding process and lose their color strength, so that they have to be printed on top of each other several times in order to obtain sufficient color intensity. Despite the fine grinding process, nozzle clogging and sedimentation problems are not uncommon with conventional ink-jet processes. These problems cannot occur with the method according to the invention.

Surprisingly, the measures according to the invention lead to an improvement in the print quality, so that in particular the satellite formation described above and below is reduced.

The present printing process is used to transfer printing substance from an ink carrier to a substrate. The ink carrier from which the printing substance is removed, is not particularly limited. For example, the ink carrier can be made transparent, the light beam preferably being focused from the side of the ink carrier facing away from the printing substance through it into the printing substance. A gas bubble then forms explosively on the side of the absorption body facing the ink carrier, which ensures that the absorption body is accelerated in the direction of the printing material. In particular when using transparent printing substances, an ink carrier is preferably used, on the surface of which there are absorption bodies provided for receiving the printing substance, which preferably form a solid layer.

Furthermore, it can be provided that an ink carrier is used on whose surface there are absorption bodies, which preferably form a solid layer, and are provided for receiving the printing substance.

In one embodiment, the ink carrier can be designed as a circumferential band. The ink carrier is preferably designed in the form of a flexible tape which comprises a layer with a printing substance.

The layer with a printing substance which is provided on the ink carrier is preferably renewed after the process time in which at least part of the printing substance undergoes a change in volume and/or position. In a further embodiment, the layer thickness of the printing substance on the ink carrier is preferably constant, so that the ink carrier preferably has no recesses.

Furthermore, it can be provided that the layer with a printing substance which is provided on the ink carrier, initially after the process time in which at least part of the printing substance undergoes a change in volume and/or position is at least partially removed, preferably wiped off, before it is preferably renewed.

The method according to the invention transfers a printing substance to a substrate material. The substrate is not particularly limited. It can therefore be made from common materials such as glass, ceramic, metal, wood or plastic.

In the present printing process, the printing substance undergoes a change in volume and/or position with using an energy-emitting device which emits energy in the form of electromagnetic waves during a process time. Accordingly, the printing substance is preferably transmitted directly or indirectly by the action of electromagnetic waves from the ink carrier to the printing substrate.

The energy-emitting device advantageously emits energy in the form of laser light. With the use of highly coherent monochromatic laser light, a relatively high amount of energy can be emitted onto a very small area with very short light pulses. This increases the quality of the print image, in particular the resolution. A short light pulse does not necessarily have to come from a pulsed laser. On the contrary, it is even advantageous if a laser is used in CW (continuous wave) mode instead. The pulse duration or, better still, the exposure time does not then depend on the length of the laser pulse, but on the scanning speed of the laser beam. Furthermore, the data to be transmitted no longer have to be synchronized to the fixed pulse frequency.

In a particularly preferred embodiment of the present invention, the energy-emitting device or the beam path of the electromagnetic waves is arranged such that the absorption bodies are accelerated in the direction of the printing substrate by the electromagnetic waves of the energy-emitting device. As a result, the change in volume and/or position of the printing substance is supported in an advantageous manner. This is because the acceleration of the absorption body alone causes a kind of shock wave in the printing substance, so that, in combination with the gas bubble that forms, a defined droplet detachment is promoted In a preferred embodiment, the ink carrier is irradiated with the electromagnetic waves from the side which is arranged opposite the paint layer. In this case, a transparent ink carrier can preferably be used, as was explained in more detail above.

The wavelength of the electromagnetic wave with which the energy-emitting device couples the energy into the ink carrier or the printing substance is not particularly limited, but can be matched to the absorption bodies contained in the ink carrier or the printing substance. Energy is preferably transmitted from the electromagnetic wave into the printing substance with the aid of absorption bodies. Absorption bodies are preferably used which are smaller than the wavelength of the electromagnetic waves, preferably smaller than 1/10, particularly preferably smaller than 1/50 of the wavelength of the electromagnetic waves.

It can be further provided that the print dot size is controlled by the amount of energy released by the energy-emitting device.

Furthermore, it can be provided that differences in brightness of the image to be printed are realized by varying the print dot size.

In addition, it can be provided that the printing is carried out line by line, with areas to be printed within a line being formed by line segments of any length and position.

Furthermore, it can be provided that the distance between the ink carrier with the ink layer and the substrate to be printed is 50 μm to 1000 μm.

Further information on the implementation of the present method, in particular with regard to the technical design of the printing system, can be found in documents DE 197 46 174 A1, DE 100 51 850 A1 and DE 102 10 146 A1, which for the purposes of disclosure are fully incorporated into the present application.

The present printing process is characterized in that the printing substance comprises a high molecular weight binder.

This printing substance is new and therefore also the subject of the present invention. The following statements accordingly apply both to the method according to the invention and to the printing substance as such.

Surprisingly, preferred printing substances have any or all of the following criteria:

The viscosity should preferably be adjusted so that the printing substance is easy to flow and thus enables the transport from the ink tank to the coating station and the return flow.

The printing substance preferably has a high content of inorganic material in order to leave sufficient material on the substrate after a printing process, e.g. to create a covering layer of ink.

The printing substance couples energetically with the laser beam resulting in pulse-like detachment of the ink droplets.

A preferred printing substance wets the substrate e.g. glass, sufficiently well, that a printed line as such remains on the substrate, i.e. it adheres well without overflowing. This property can be influenced, inter alia, by the viscosity.

The printing substance comprises a high molecular weight binder. The high molecular weight binder preferably has a weight average molecular weight in the range from 100,000 to 10,000,000 g/mol, preferably 150,000 to 5,000,000 g/mol, particularly preferably 200,000 to 2,000,000 g/mol and especially preferably 250,000 to 1,000,000 g/mol, measured by GPC.

In a preferred embodiment, it can be provided that the high molecular weight binder is a polymer containing amino groups, a polymer containing ether groups, a polymer containing ester groups, a polymer containing amide groups, a polymer containing acid groups or a polymer containing hydroxyl groups, preferably a polyvinyl alcohol, a (meth) acrylate, a (meth) acrylate containing hydroxyl groups, a poly (meth) acrylic acid and their salts, a polyacrylamide, a polyvinylpyrrolidone, a polyethylene glycol, a styrene-maleic anhydride copolymer and their salts, a polysaccharide, particularly preferably a cellulose or a modified cellulose, particularly preferably methyl methacrylate, methyl methacrylate copolymer, hydroxyethyl cellulose, carboxymethyl cellulose, hydroxypropylmethyl cellulose, hydroxypropyl cellulose, ethylhydroxyethyl cellulose.

Hydroxyethyl celluloses with a molar degree of substitution in the range from 1 to 8, preferably 1.5 to 6, particularly preferably 2.0 to 5 and especially preferably 2.2 to 4 are particularly preferred.

Hydroxypropylmethylcelluloses with a molar degree of substitution in the range from 1 to 10, preferably 2 to 7, are particularly preferred preferably 2.5 to 5.5 and especially preferably 3 to 5.

(Meth) acrylates are also preferred which have at least 80% by weight, preferably at least 90% by weight and particularly preferably at least 95% by weight of units which are derived from methyl methacrylate. Especially preferred are in particular (meth) acrylates which contain up to 20% by weight, preferably up to 10% by weight, of units derived from comonomers. Preferred comonomers are particularly preferably selected from alkyl (meth) acrylates, such as butyl (meth) acrylate, cyclohexyl (meth) acrylate, 2-ethylhexyl (meth) acrylate; and hydroxylalkyl (meth) acrylates such as 3-hydroxypropyl (meth) acrylate, 3,4-dihydroxybutyl (meth) acrylate, 2-hydroxyethyl (meth) acrylate, 2-hydroxypropyl (meth) acrylate.

Of the high molecular weight binders mentioned above, ethylhydroxyethyl celluloses, hydroxypropylmethyl celluloses and (meth) acrylates are particularly preferred, with hydroxypropylmethyl celluloses and (meth) acrylates being particularly preferred.

These polymers can be obtained commercially from a variety of suppliers. These include Degalan® and Klucel®, preferably Degalan® LP 62/05, Klucel® H, Klucel® M and Klucel® G.

It can also be provided that the high molecular weight binder has a solubility in a polar solvent, for example dipropylene glycol methyl ether of at least 0.5 g, preferably at least 1 g, particularly preferably at least 1.5 g per 100 g of solvent.

It can also be provided that the printing substance is 0.01 to 5% by weight, preferably 0.05 to 3% by weight, particularly preferably 0.07 to 2% by weight, and especially preferably 0.08 to 1.5% by weight of high molecular weight binder.

In a further preferred embodiment it can be provided that the printing substance contains absorption bodies. The absorption bodies interact with the electromagnetic waves described above. Accordingly, in particular a pigment, preferably an inorganic pigment or carbon black, can be contained in the printing substance.

Depending on the design of the printing substance, it can comprise higher or lower proportions of absorption bodies. A printing substance which only comprises carbon black as the absorption body preferably has a carbon black content in the range from 0.5 to 3.0% by weight, particularly preferably from 0.8 to 1.5% by weight. Printing substances which contain inorganic pigments as absorption bodies have preferably 2 to 40% by weight, particularly preferably 3 to 25% by weight, absorption bodies or inorganic pigments.

In a particular embodiment, the printing substance preferably comprises at least one high molecular weight binder, at least one low molecular weight binder and at least one functional carrier.

The functional carrier here denotes a substance which leads to a function on a substrate which can be given, for example, in a coloring and/or the provision of a conductivity of the decoration produced by the printing substance. The preferred functional carriers include, inter alia, inorganic pigments, glass fluxes and/or metal particles, preferably silver particles. The functional carrier therefore remains on the substrate after curing as described later, while other solid constituents remain on the substrate after drying, but are removed from the substrate by curing at a high temperature. These other solid constituents include, depending on the curing conditions, the binders set out above and carbon black.

The printing substance preferably has mineral pigments, which particularly preferably act as absorption bodies. In a further embodiment, the printing substance preferably has metal particles, preferably silver particles.

Furthermore, it can be provided that the function carrier is in particle form, the particles preferably having a d50 value in the range from 0.5 μm to 30 μm, particularly preferably in the range from 1 μm to 20 μm and especially preferably in the range from 2 μm to 15 μm.

The printing substance preferably has a high content of functional carrier, in particular of inorganic pigments, glass fluxes and/or metal particles, the printing substance preferably comprising up to 85% by weight, particularly preferably up to 70% by weight, of functional carrier. A glass flux is preferably used in printing substances that are cured on the substrate at very high temperatures. Printing substances that are cured or dried at a temperature below 400° C. preferably do not comprise any glass flux.

The low molecular binder has a lower molecular weight than that of high molecular weight binders. The weight average molecular weight (Mw) of the high molecular weight binder is preferably at least 20% greater than the weight average molecular weight (Mw) of the low molecular weight binder, preferably at least 50%, particularly preferably at least 100%, the percentages being based on the weight average molecular weight (Mw) of the low molecular weight binder. It can preferably be provided that the low molecular weight binder has a weight average molecular weight (Mw) in the range from 10,000 to 150,000 g/mol, preferably in the range from 50,000 to 100,000 g/mol, measured according to GPC. The low molecular weight binder preferably comprises a polymer containing amino groups, a polymer containing ether groups, a polymer containing ester groups, a polymer containing amide groups, a polymer containing acid groups or a polymer containing hydroxyl groups, preferably a polyvinyl alcohol, a (meth) acrylate, a hydroxyl group-containing (meth) acrylate, a poly (meth) acrylic acid and its salts, a polyacrylamide, a polyvinylpyrrolidone, a polyethylene glycol, a styrene-maleic anhydride copolymer and its salts, a polysaccharide, particularly preferably a cellulose or a modified cellulose, particularly preferably methyl methacrylate, methyl methacrylate copolymer, hydroxyethyl cellulose, carboxymethyl cellulose, carboxymethyl cellulose, Hydroxypropyl cellulose, ethyl hydroxyethyl cellulose.

These polymers can be obtained commercially from a variety of suppliers. These include Klucel® E and Klucel® J (Hydroxypropylmethyl cellulose) as well as Aqualon® N10 and Aqualon® N22 (hydroxyethyl cellulose).

It can further be provided that the low molecular weight binder has a solubility in a polar solvent, for example dipropylene glycol methyl ether of at least 0.5 g, preferably at least 1 g, particularly preferably at least 1.5 g per 100 g of solvent.

The printing substance preferably comprises 0.1 to 10% by weight, preferably 0.2 to 7% by weight and particularly preferably 0.3 to 5% by weight of low molecular weight binder.

It can also be provided that the printing substance has a solids content of at least 30% by weight, preferably at least 50% by weight and particularly preferably at least 60% by weight.

It can preferably be provided that the printing substance comprises at least one propellant, which preferably has a boiling point in the range from 60° C. to 250° C., particularly preferably in the range from 80° C. to 200° C., especially preferably in the range from 140° C. to 190° C. The propellant is preferably a solvent which preferably comprises ethers, in particular diglycols, aliphatic hydrocarbons, aromatic hydrocarbons, hydroaromatic hydrocarbons, Texanol®, alcohols, esters, ketones and/or water. Organic solvents, in particular ethers, preferably diglycols, aliphatic hydrocarbons, aromatic hydrocarbons, hydroaromatic hydrocarbons, Texanol®, alcohols, esters and/or ketones are preferred here.

The printing substance preferably comprises 15 to 80% by weight, more preferably 20 to 70% by weight and particularly preferably 25 to 50% by weight of propellant.

The printing substance is preferably flowable, the printing substance particularly preferably having a viscosity in the range from 400 to 4500 mPas, particularly preferably a viscosity in the range from 500 to 3200 mPas, in the range from 800 to 2600 mPas, especially preferably in the range from 1000 to 2200 mPas measured at 20° C. at a shear rate of 2 $s^{-1}$, measured with a plate/cone. (Rotational viscometer CVO120 from Bohlin, plate-cone method (2°), based on DIN 53019; in particular DIN 53019-1: 2008-09, DIN 53019-2: 2001-02, DIN 53019-3: 2008-09, DIN 53019-4: 2016-10).

The printing substance is preferably flowable, the printing substance particularly preferably having a viscosity in the range from 200 to 4000 mPas, particularly preferably a viscosity in the range from 400 to 2800 mPas, in the range from 550 to 2000 mPas, especially preferably in the range from 700 to 1600 mPas measured at 20° C. at a shear rate of 10 $s^{-1}$, measured with a plate/cone. (Rotational viscometer CVO120 from Bohlin, plate-cone method (2°), based on DIN 53019; in particular DIN 53019-1: 2008-09, DIN 53019-2: 2001-02, DIN 53019-3: 2008-09, DIN 53019-4: 2016-10).

The printing substance is preferably flowable, the printing substance particularly preferably having a viscosity in the range from 100 to 3500 mPas, particularly preferably a viscosity in the range from 200 to 2400 mPas, in the range from 400 to 1600 mPas, especially preferably in the range from 600 to 1200 mPas measured at 20° C. at a shear rate of 50 $s^{-1}$, measured with a plate/cone. (Rotational viscometer CVO120 from Bohlin, plate-cone method (2°), based on DIN 53019; in particular DIN 53019-1: 2008-09, DIN 53019-2: 2001-02, DIN 53019-3: 2008-09, DIN 53019-4: 2016-10).

The printing substance is preferably flowable, the printing substance particularly preferably having a viscosity in the range from 50 to 3000 mPas, particularly preferably a viscosity in the range from 100 to 2000 mPas, in the range from 250 to 1400 mPas, especially preferably in the range from 500 to 1000 mPas measured at 20° C. at a shear rate of 200 $s^{-1}$, measured with a plate/cone. (Rotational viscometer CVO120 from Bohlin, plate-cone method (2°), based on DIN 53019; in particular DIN 53019-1: 2008-09, DIN 53019-2: 2001-02, DIN 53019-3: 2008-09, DIN 53019-4: 2016-10).

The printing substance is preferably flowable, the printing substance particularly preferably having a viscosity in the range from 25 to 2800 mPas, particularly preferably a viscosity in the range from 50 to 2000 mPas, in the range from 200 to 1200 mPas, especially preferably in the range from 400 to 800 mPas measured at 20° C. at a shear rate of 600 $s^{-1}$, measured with a plate/cone. (Rotational viscometer CVO120 from Bohlin, plate-cone method (2°), based on DIN 53019; in particular DIN 53019-1: 2008-09, DIN 53019-2: 2001-02, DIN 53019-3: 2008-09, DIN 53019-4: 2016-10).

The viscosity properties set out above, which are maintained at different shear rates, of preferred printing substances can be realized individually or completely, with preferably at least two, particularly preferably three, especially preferably four and very particularly preferably all viscosity properties being observed. In this way, a particularly preferred printing substance can be provided which exhibits a specific thixotropy and is nevertheless still flowable under the shear force conditions in the printing apparatus.

In a preferred embodiment it can be provided that the printing substance shows viscoelastic behavior. Viscoelastic are substances that are between the extremes—ideally viscous liquids with tan (delta)=G2/G1>100 and ideally elastic solids with tan (delta)=G2/G1<0.01. G1 is the storage modulus, G2 the loss modulus. These parameters are determined in the course of oscillation measurements (step test measurements), measured with an "Anton Paar Rheo-Compass" from Anton Paar. Plate-plate, gap width about 0.5 mm at 20° C. (Modular Compact Rheometer MCR302 from Anton Paar, plate-plate method, based on DIN 53019; in particular DIN 53019-1: 2008-09, DIN 53019-2: 2001-02, DIN 53019-3: 2008-09, DIN 53019-4: 2016-10). The angular velocity ω, especially when jumping, is preferably 3.14 rad/s and the deflection δ is preferably 0.1%.

In a preferred embodiment it can be provided that the storage module G1 is at least 8 Pa, preferably at least 10 Pa and especially preferably at least 12 Pa, measured by means of oscillation measurements with an "Anton Paar Rheo-Compass" from Anton Paar. Plate—Plate, Gap width about 0.5 mm at 20° C.

In a preferred embodiment it can be provided that the loss modulus G2 is at least 6 Pa, preferably at least 8 Pa and especially preferably at least 10 Pa, measured by means of oscillation measurements with an "Anton Paar Rheo-Compass" from Anton Paar. Plate—Plate, Gap width about 0.5 mm at 20° C.

It is particularly preferred that the printing substance has a high elastic component, i.e. G1 is close to G2 and at the same time it is flowable under the shear forces prevailing in the apparatus (i.e. tan (delta) in the range of preferably 0.05 to 3.0, particularly preferably 0.05 to 1.3). The angular velocity Ω, especially when jumping, is preferably 3.14 rad/s and the deflection δ is preferably 0.1%.

In a preferred embodiment it can be provided that the storage modulus G1 is at least 8 Pa, preferably at least 10 Pa and especially preferably at least 12 Pa, measured by means of oscillation measurements with an "Anton Paar Rheo-Compass" from Anton Paar. Plate-plate, gap width about 0.5 mm at 20° C.

In a preferred embodiment, it can be provided that the loss modulus G2 is at least 6 Pa, preferably at least 8 Pa and especially preferably at least 10 Pa, measured by means of oscillation measurements with an "Anton Paar Rheo-Compass" from Anton Paar. Plate-plate, gap width about 0.5 mm at 20° C.

It is particularly preferred that the printing substance has a high elastic component, i. G1 is close to G2 and at the same time it is flowable under the shear forces prevailing in the apparatus (i.e. tan (delta) in the range of preferably 0.05 to 3.0, particularly preferably 0.05 to 1.3). The angular velocity Ω, particularly when jumping, is preferably 3.14 rad/s and the deflection δ is preferably 0.1%.

In preferred embodiments, tan (delta)=G2/G1 is preferably in the range from 0.05 to 3.0, particularly preferably 0.1 to 2.8, particularly preferably 0.2 to 2.5 and especially preferably 0.3 to 2.3, measured by means of oscillation measurements with an "Anton Paar Rheo-Compass" from Anton Paar. Plate-plate, gap width about 0.5 mm at 20° C. The angular velocity Ω, in particular when jumping, is preferably 3.14 rad/s and the deflection δ is preferably 0.1%.

In preferred embodiments, tan (delta)=G2/G1 is preferably in the range from 0.05 to 1.3, particularly preferably 0.1 to 1.1, particularly preferably 0.2 to 1.0 and especially preferably 0.3 to 0.9, measured by means of oscillation measurements with an "Anton Paar Rheo-Compass" from Anton Paar. Platte-Platte, gap width about 0.5 mm at 20° C. The angular velocity Ω, especially when jumping, is preferably 3.14 rad/s and the deflection δ preferably 0.1%.

In a further embodiment it can be provided that tan (delta)=G2/G1, preferably due to the presence of the high molecular weight binder, by at least 30%, preferably by at least 50% compared to an essentially identical composition, which in particular has the same viscosity at 25° C. and a shear stress of 200 $s^{-1}$, but no high molecular weight binder 10 decreases, measured by means of oscillation measurements with an "Anton Paar RheoCompass" from Anton Paar. Plate-plate, gap width about 0.5 mm at 20° C. The angular velocity Ω, especially when jumping, is preferably 3.14 rad/s and the deflection δ is preferably 0.1%.

It can preferably be provided that the ratio of tan (delta)=G2/G1 of a composition according to the invention with a high molecular weight binder to the tan (delta)=G2/G1 of a substantially the same composition without high molecular weight binder, which in particular has the same viscosity 25° C. and a shear stress of 200 Hz $s^{-1}$, preferably at most 0.9, preferably at most 0.7, particularly preferably at most 0.6.

The previously presented values of the storage modulus G1, the loss modulus G2 and the tan (delta) are determined at a plateau, which generally occurs after a period of about 5 to 9 minutes in an oscillation test. These values are preferably reached again after a short shear stress (about 20 seconds) by a rotation of 100 $s^{-1}$ after a time of about 5 minutes, so that in preferred embodiments there is no degradation of the polymers which lead to these values.

It can also be provided that the surface tension of the printing substance is in the range from 26 to 34 mN/m, preferably 28 to 32 mN/m, measured according to the Wilhelmy plate method with a "Force Tensiometer" from Kruss at 20° C. Another object of the present invention is the use of a printing substance according to the invention, which is characterized in that the printing substance is applied to glass, ceramic, metal, wood or plastic.

Preferably, after application of the printing substance to a substrate, hardening can take place, the hardening preferably taking place at a temperature in the range from 150° C. to 1200° C., particularly preferably 150° C. to 220° C. or 500° C. to 1000° C.

In a preferred embodiment, the layer can be dried at 100° C. to 150° C. after printing in order to remove volatile media components, in particular propellants or solvents. The burn-in then takes place preferably at 500° C. to 1000° C. in the case of printing substances, which contain inorganic, preferably mineral pigments and/or glass fluxes. Printing substances with glass fluxes can contain metal particles, in particular silver particles. Printing substances, preferably at 500° C. to 1000° C. are baked, are preferably provided to be applied to inorganic substrates, for example glass plates or the like. Printing substances with metal particles, preferably silver particles, that do not contain mineral pigments or contain glass fluxes are preferably hardened at a temperature in the range 150° C. to 250° C. Such printing substances, which are preferably cured at 150° C. to 250° C., are preferably intended for use on plastic substrates or the like to be applied.

The present invention may be better understood, and its numerous objects, features and advantages made apparent to those skilled in the art by referencing the accompanying drawings.

FIG. 10 is a photograph at 100 times magnification of a comparative example paste baked on substrate in accordance with the present subject matter.

The present invention is explained in more detail below using examples, such examples not limiting the invention.

INVENTIVE EMBODIMENT EXAMPLE 1

A color paste from Ferro GmbH based on the glass color powder 14305 and the medium C7 (both Ferro GmbH) is adjusted to a viscosity of 960 mPas with Dowanol DPM and a hydroxylpropyl cellulose with a molecular weight of 850,000 g/mol, measured at 20° C. and a shear rate of 200/sec, the concentration of this active substance being about 0.09% by weight.

The color paste is transferred to glass plates (format 100×100×4 mm) using the printing process described above and baked at 690° C. The photos shown in FIG. 1 show a detail with 100 or 30 times magnification. The printed substrate shows only very little satellite formation, as can be seen from FIGS. 1A (100 times magnification) and 1B (30 times magnification), represent the light microscope images of the decoration.

COMPARATIVE EXAMPLE 1

Inventive Embodiment Example 1 is essentially repeated, but no hydroxypropyl cellulose with a molecular weight of 850,000 g/mol is used, the viscosity likewise being in the range of approximately 960 mPas.

The color paste is transferred to glass plates (format 100×100×4 mm) using the printing process described above and baked at 690° C. The photos show a section enlarged 100 or 30 times. The printed substrate now shows a very clear satellite formation, as can be seen from FIGS. 1C (100 times magnification) and 1D (30 times magnification).

INVENTIVE EMBODIMENT EXAMPLE 2

An ink based on the inorganic components of the silver paste TSP2002 from Ferro GmbH is adjusted to a viscosity of 487 mPas with Dowanol DPM and a hydroxylpropyl cellulose with a molecular weight of 850,000 g/mol, measured at 20° C. and a shear rate of 200/sec, the The concentration of this active substance is about 0.13% by weight.

Figure 1A:
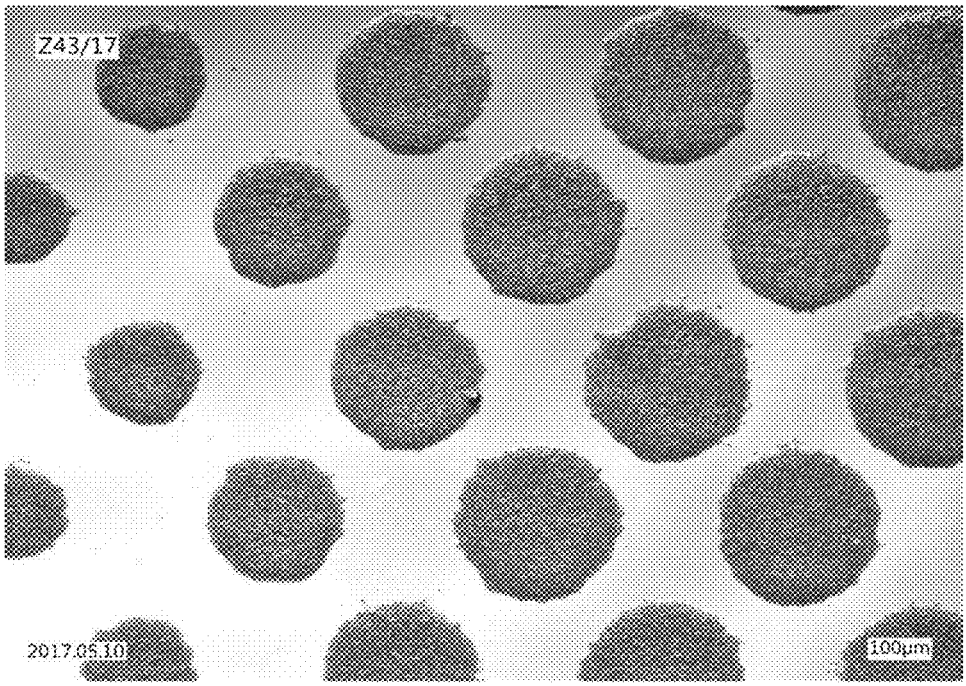
FIG. 1A is a photograph at 100 times magnification of an example paste baked on a substrate in accordance with the present subject matter.
Figure 1B:
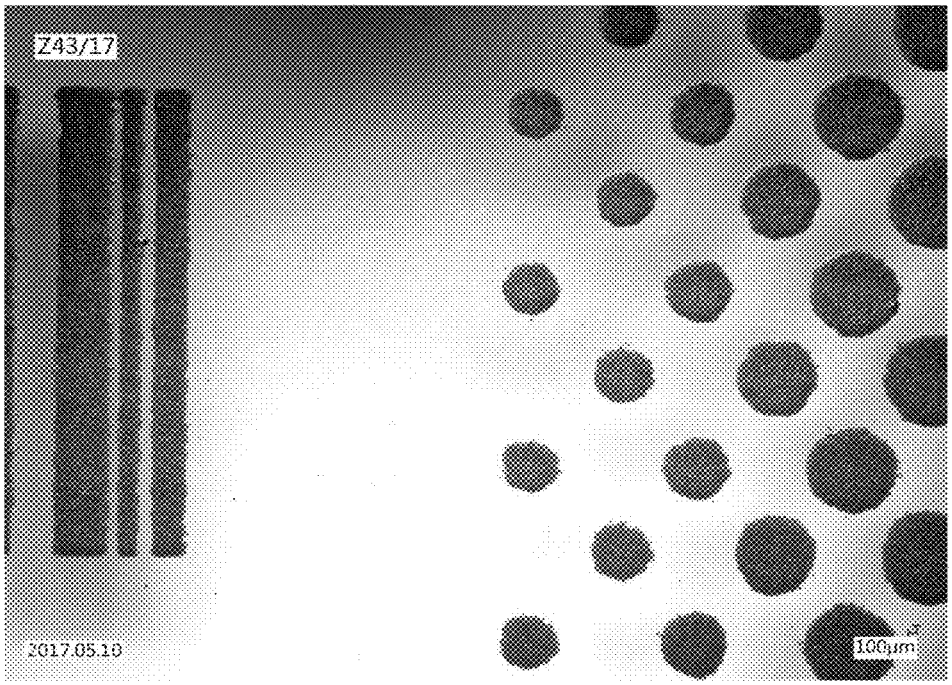
FIG. 1B is a photograph of the example paste of FIG. 1A at 30 times magnification.
Figure 1C:
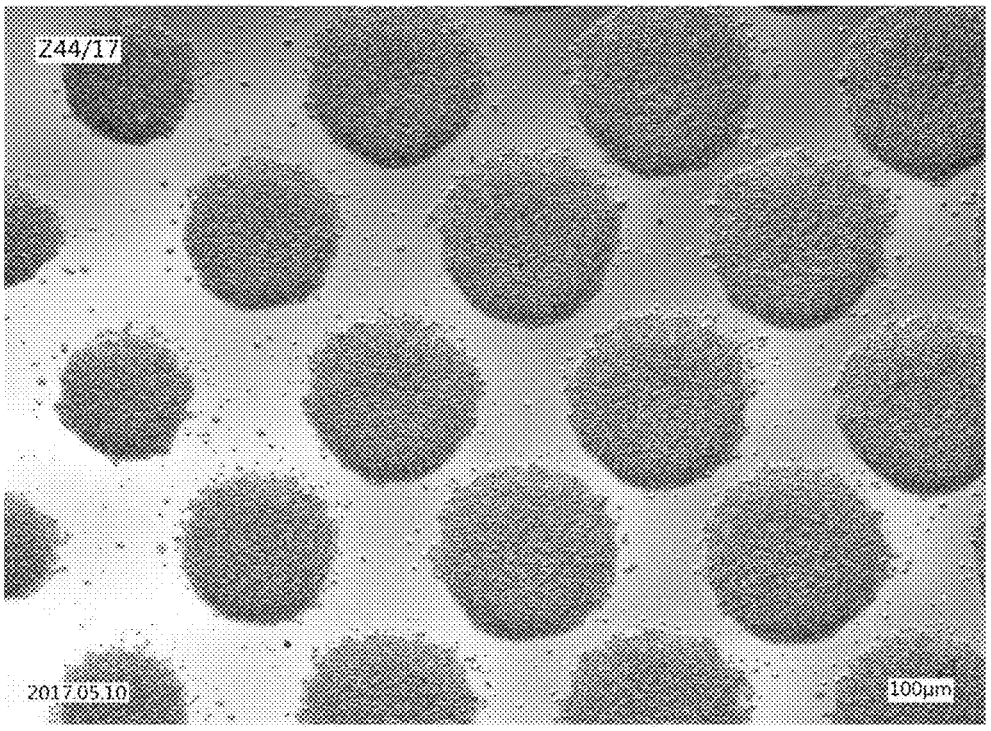
FIG. 1D is a photograph of the comparative paste of FIG. 10 at 30 times magnification.
Figure 1D:
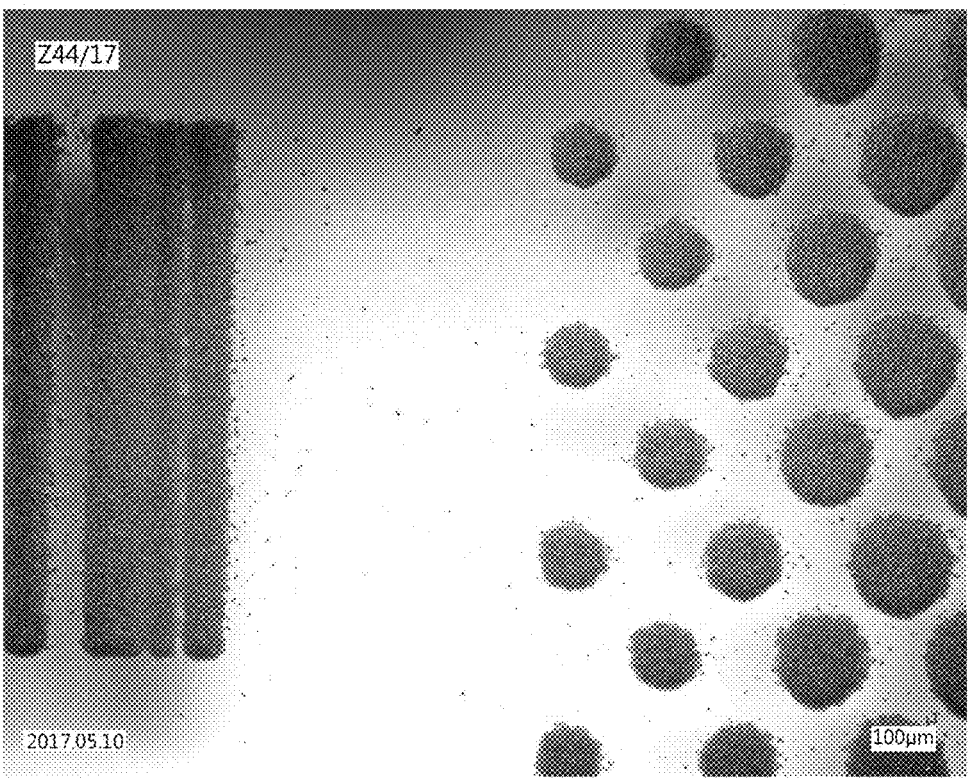
Figure 2A:
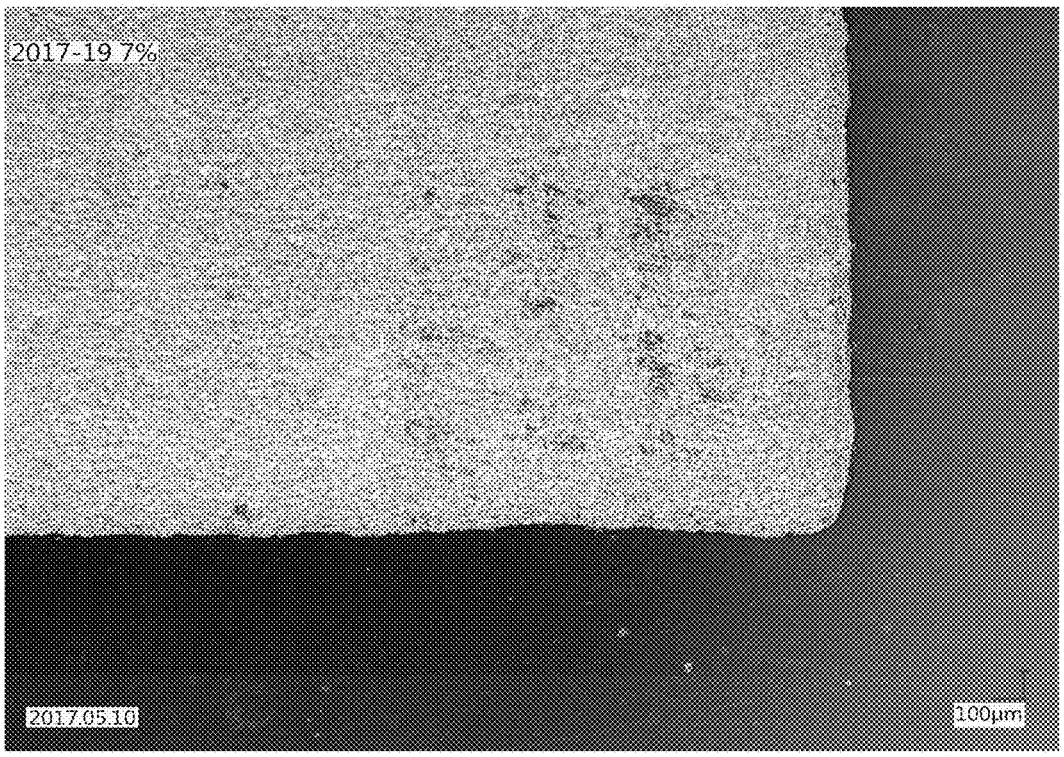
FIG. 2A is a photograph at 100 times magnification of another example paste baked on a substrate in accordance with the present subject matter.
Figure 2B:
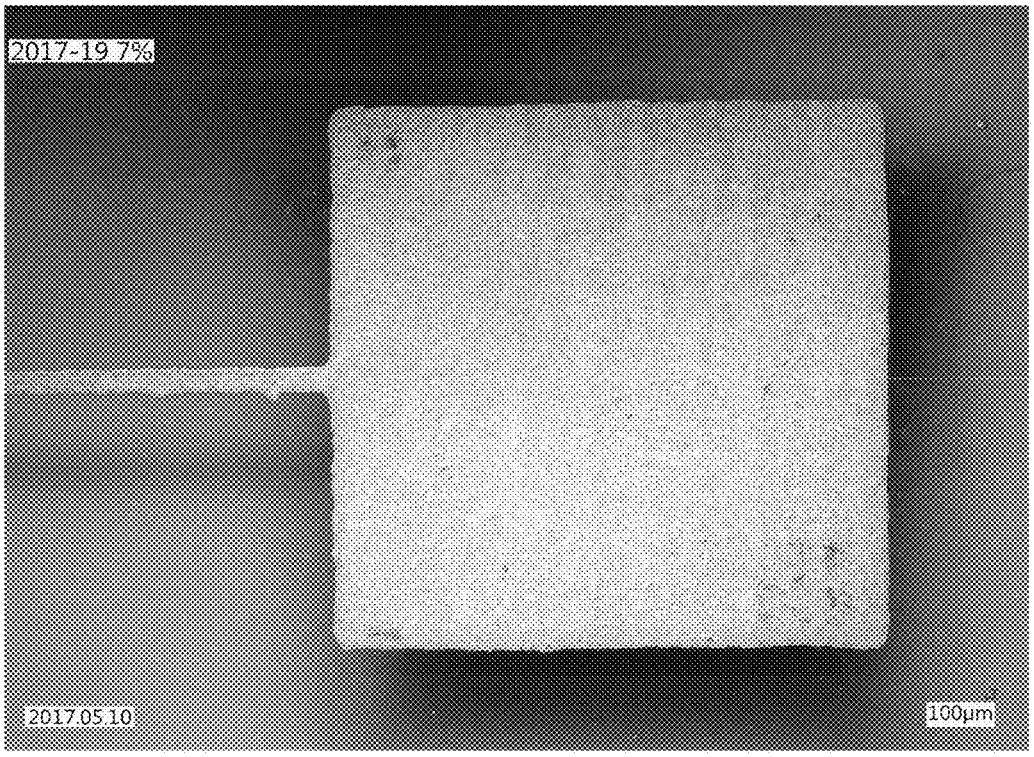
FIG. 2B is a photograph of the example paste of FIG. 2A at 30 times magnification.

The ink is transferred to glass plates (format 100×100×4 mm) by means of the printing process described above and baked at 690° C. The printed substrate shows only very little satellite formation, this being evident from FIGS. 2A (100 times magnification) and 2B (30 times magnification), which represent light microscopic images of the decoration.

COMPARATIVE EXAMPLE 2

Inventive Embodiment Example 2 is essentially repeated, but no hydroxypropyl cellulose with a molecular weight of 850,000 g/mol is used, the viscosity likewise being in the range of approximately 480 mPas.

Figure 2C:
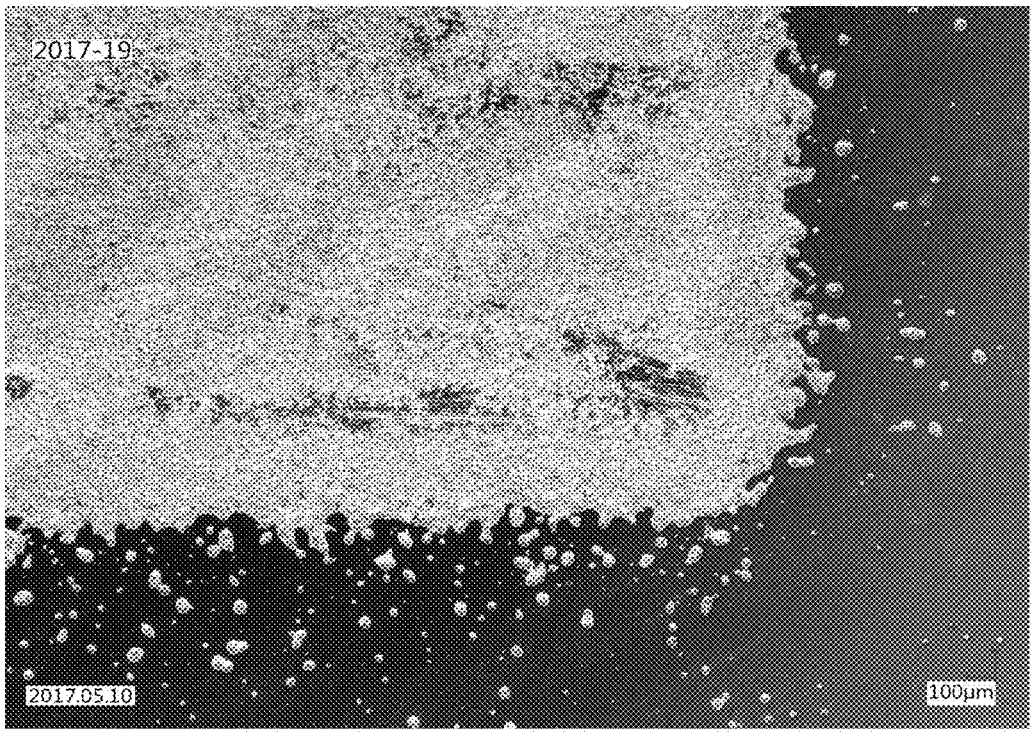
FIG. 2C is a photograph at 100 times magnification of another comparative example paste baked on substrate in accordance with the present subject matter.
Figure 2D:
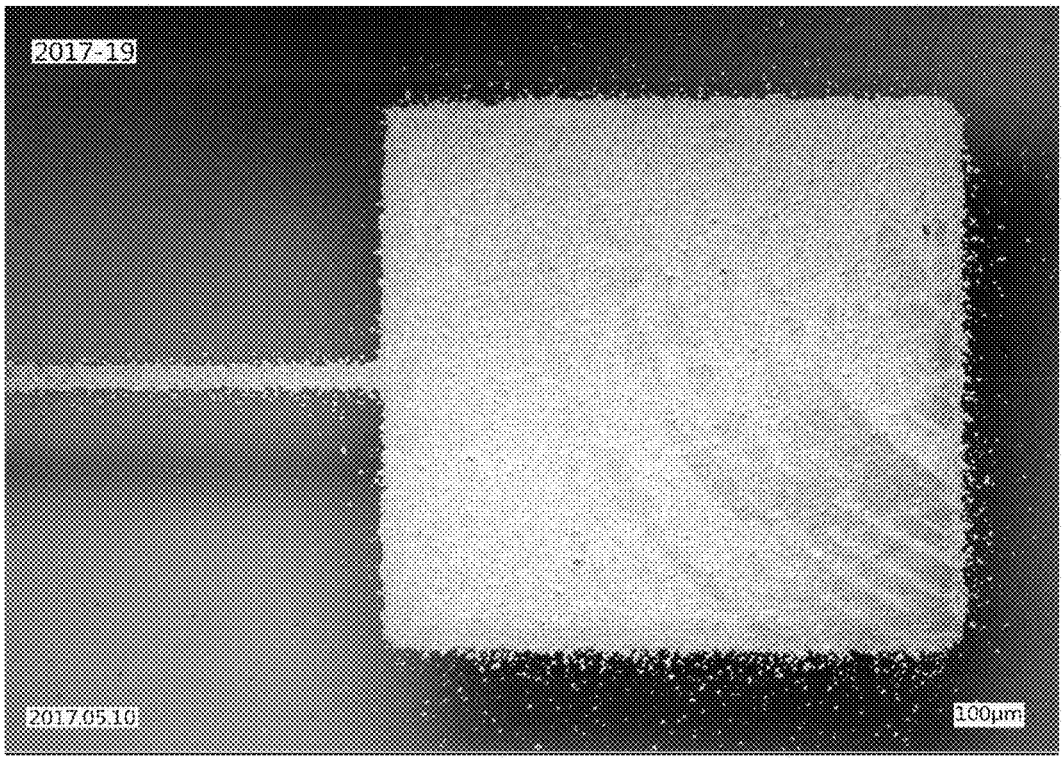
FIG. 2D is a photograph of the comparative paste of FIG. 2C at 30 times magnification.

The color paste is transferred to glass plates (format 100×100×4 mm) using the printing process described above and baked at 690° C. The photos show a section enlarged 100 or 30 times. The printed substrate now shows a very clear satellite formation, as can be seen from FIGS. 2C (100 times magnification) and 2D (30 times magnification).

INVENTIVE EMBODIMENT EXAMPLE 3

A color paste from Ferro GmbH based on the glass color powder 14297 and the medium C7 (both Ferro GmbH) is adjusted with Dowanol DPM and a hydroxylpropyl cellulose with a molecular weight of 850,000 g/mol to a viscosity of approx Shear rate of 200/sec, the concentration of this active substance being about 0.09% by weight.

The viscosity properties are determined by a jump test, with oscillation initially for about 9 minutes, the oscillation being interrupted for about 15 seconds by a shear rotation at 100 $s^{-1}$ and then oscillating again for about 5 minutes (20° C.). The storage modulus G1 is about 25.0 Pa after 8 minutes (plateau phase), the loss modulus G2 about 13.9 and tan (delta) G2/G1 about 0.56. After about 12.5 minutes the storage modulus G1 is about 25.1 Pa, the loss modulus G2 about 14.5 Pa and tan (delta) G2/G1 about 0.58.

The color paste is transferred to a substrate by means of the printing process described above and cured. The printed substrate shows only very little satellite formation.

INVENTIVE EMBODIMENT EXAMPLE 4

A color paste from Ferro GmbH based on the glass color powder 144012 and the medium 801016 (both Ferro GmbH) is adjusted to a viscosity of about 860 mPas with Dowanol DPM and a hydroxylpropyl cellulose with a molecular weight of 370,000 g/mol, measured at 20° C. Shear rate of 200/sec, the concentration of this active substance being about 0.29% by weight.

The color paste is transferred to a substrate by means of the printing process described above and cured. The printed substrate shows only very little satellite formation.

INVENTIVE EMBODIMENT EXAMPLE 5

A color paste from Ferro GmbH based on the glass color powder 14510 and the medium C7 (both Ferro GmbH) is adjusted to a viscosity of 860 mPas with Dowanol DPM and a hydroxylpropyl cellulose with a molecular weight of 850,000 g/mol, measured at 20° C. and a shear rate of 200/sec, the concentration of this active substance being about 0.09% by weight.

The color paste is transferred to a substrate by means of the printing process described above and cured. The printed substrate shows only very little satellite formation.

INVENTIVE EMBODIMENT EXAMPLE 6

A color paste from Ferro GmbH based on the glass color powder 14297 and the medium C7 (both Ferro GmbH) is adjusted to a viscosity of 625 mPas with a solution of an n-BUMA/MMA copolymer with a molecular weight of 250000 g/mol in glycol ether, measured at 20° C. and a shear rate of 200/sec, the concentration of this active substance being about 1.25% by weight.

The viscosity properties are determined by a step test, with oscillation initially for about 9 minutes, the oscillation being interrupted for about 15 seconds by a shear rotation at 100 $s^{-1}$ and then oscillating again for about 5 minutes (20° C.). The storage modulus G1 is about 57.0 Pa after 8 minutes (plateau phase), the loss modulus G2 about 31.7 and tan (delta) G2/G1 about 0.56. After about 13 minutes the storage modulus G1 is about 44.6 Pa, the loss modulus G2 about 29.7 Pa and tan (delta) G2/G1 about 0.67.

Figure 3:
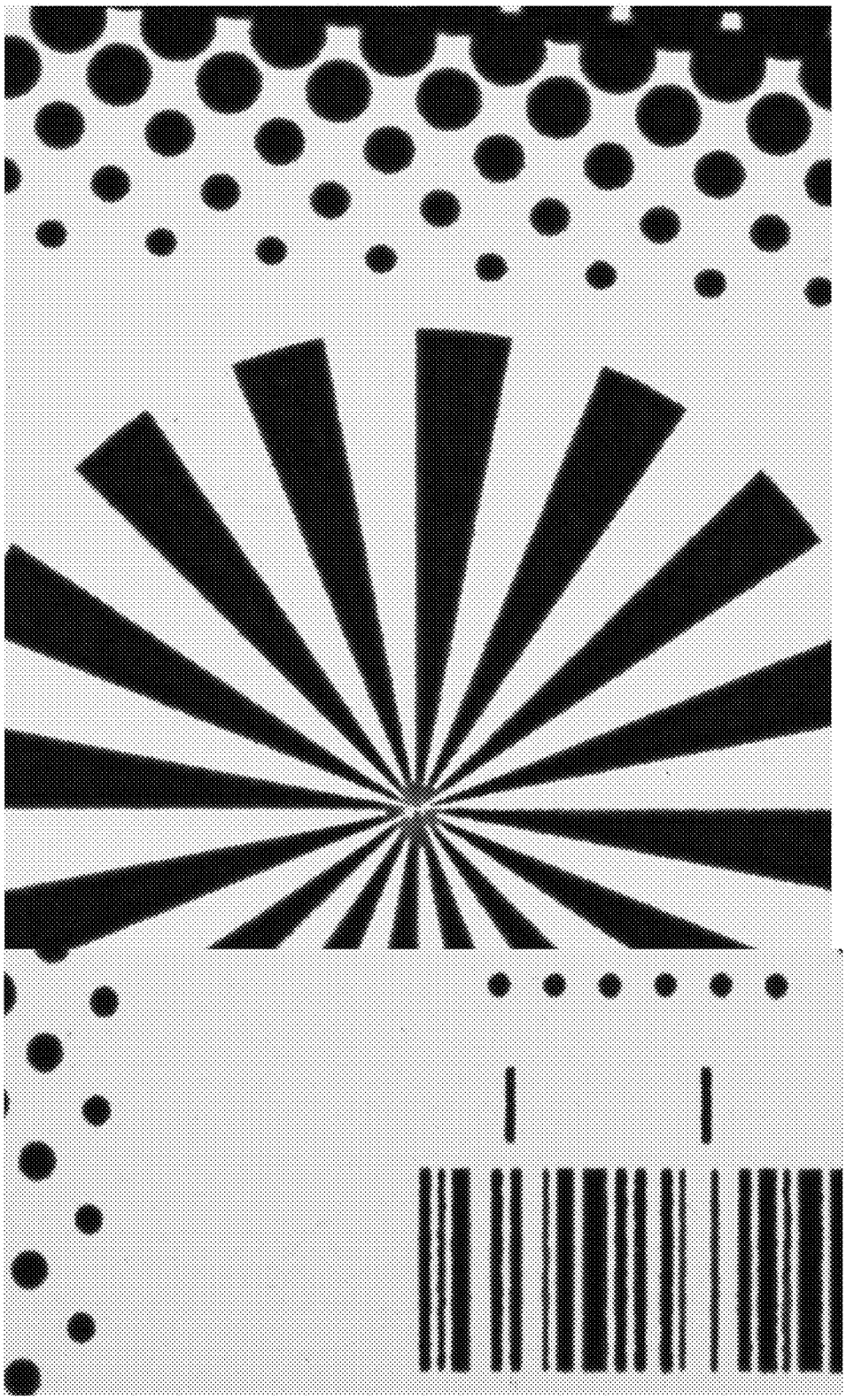
FIG. 3 is an enlarged photograph of another example paste cured on a substrate in accordance with the present subject matter.

The color paste is transferred to a substrate by means of the printing process described above and cured. The printed substrate shows only a very slight satellite formation, this being evident from FIG. 3, which shows enlarged sections from a photo of the decoration.

INVENTIVE EMBODIMENT EXAMPLE 7

An ink based on the inorganic components of the silver paste TSP2042 from Ferro GmbH is adjusted to a viscosity of 400 mPas with Dowanol DPM and a hydroxylpropyl cellulose with a molecular weight of 850,000 g/mol, the concentration of this active substance being about 0.18% by weight.

The ink is transferred to a substrate by means of the printing process described above and cured. The printed substrate shows only very little satellite formation.

INVENTIVE EMBODIMENT EXAMPLE 8

A color paste from Ferro GmbH based on the glass color powder 14297 and a medium based on glycol ether containing about 2.25% low molecular weight binder with approx set about 750 mPas, measured at 20° C. and a shear rate of 200/sec, the concentration of the high molecular weight active substance being about 0.09% by weight.

The color paste is transferred to a substrate by means of the printing process described above and cured. The printed substrate shows only a very slight satellite formation like embodiment 1.

INVENTIVE EMBODIMENT EXAMPLE 9

A color paste from Ferro GmbH based on the glass color powder 14297 and the medium C7 (both Ferro GmbH) is adjusted to a viscosity of 800 mPas with Dowanol DPM and a hydroxylpropyl cellulose with a molecular weight of 370,000 g/mol, measured at 20° C. and a shear rate of 200/sec, the concentration of this active substance being about 0.17% by weight.

The viscosity properties are determined by a step test, with oscillation initially for about 9 minutes, the oscillation being interrupted for about 15 seconds by a shear rotation at 100 $s^{-1}$ and then oscillating again for about 5 minutes (20° C.). The storage modulus G1 is after 8 minutes (Plateau phase) about 21.6 Pa, the loss modulus G2 about 12.5 and tan (delta) G2/G1 about 0.58. After about 12 minutes the storage modulus G1 is about 22.6 Pa, the loss modulus G2 about 13.6 Pa and tan (delta) G2/G1 about 0.60.

The color paste is transferred to a substrate by means of the printing process described above and cured. The printed substrate shows only very little satellite formation.

COMPARATIVE EXAMPLE 3

Inventive Embodiment Example 9 is essentially repeated, but no hydroxylpropyl cellulose with a molecular weight of 370,000 g/mol is used, the viscosity likewise being in the range of about 800 mPas.

INVENTIVE EMBODIMENT EXAMPLE 10

100 parts by weight of a color paste from Ferro GmbH based on the glass color powder 14315 and the medium C7 (both Ferro GmbH) is mixed with Dowanol DPM (9.9 parts by weight) and 6.5 parts by weight of a solution of a hydroxypropyl cellulose with a molecular weight of 370,000 g/mol in DPM (7.2 parts by weight of polymer in 200 parts by weight of DPM) adjusted to a viscosity of about 1000 mPas, measured at 20° C. and a shear rate of 200/sec, the concentration of this active substance being about 0.20% by weight Minutes, the oscillation is interrupted for about 15 seconds by a shear rotation at 100 $s^{-1}$ and then oscillated again for about 4 minutes (20° C.). The tan (delta) G2/G1 after about 4 minutes is about 1.8. The color paste is transferred to a substrate by means of the printing process described above and cured. The printed substrate shows only very little satellite formation.

INVENTIVE EMBODIMENT EXAMPLE 11

100 parts by weight of a color paste from Ferro GmbH based on the glass color powder 14315 and the medium C7 (both Ferro GmbH) is mixed with Dowanol DPM (12.2 parts by weight) and 6.5 parts by weight of a solution of a hydroxypropyl cellulose with a molecular weight of 850,000 g/mol in DPM (3.6 parts by weight of polymer in 200 parts by weight of DPM) adjusted to a viscosity of about 590 mPas, measured at 20° C. and a shear rate of 200/sec, the concentration of this active substance being about 0.1% by weight. The viscosity properties are determined by a jump test, with oscillation initially for about 9 minutes, the oscillation being interrupted for about 15 seconds by a shear rotation at 100 $s^{-1}$ and then oscillation again for about 4 minutes (20° C.). The tan (delta) G2/G1 after about 4 minutes is about 2.2. The color paste is transferred to a substrate by means of the printing process described above and cured. The printed substrate shows only very little satellite formation.

INVENTIVE EMBODIMENT EXAMPLE 12

100 parts by weight of a color paste from Ferro GmbH based on the glass color powder 14315 and the medium C7 (both Ferro GmbH) is mixed with Dowanol DPM (9.4 parts by weight) and 6.5 parts by weight of a solution of a hydroxylpropyl cellulose with a molecular weight of 850,000 g/mol in DPM (3.6 parts by weight of polymer in 200 parts by weight of DPM) adjusted to a viscosity of about 1020 mPas, measured at 20° C. and a shear rate of 200/sec, the concentration of this active substance being about 0.1% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 2.0.

The color paste is transferred to a substrate by means of the printing process described above and cured. The printed substrate shows only very little satellite formation.

COMPARATIVE EXAMPLE 4

Inventive Embodiment Example 10 is essentially repeated, but no hydroxylpropyl cellulose with a molecular weight of 370,000 g/mol is used, but the viscosity is only adjusted by adding DPM, the viscosity also being in the range of about 1090 mPas. The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 3.7. The color paste is transferred to a substrate by means of the printing process described above and cured. The printed substrate now shows a very clear satellite formation.

COMPARATIVE EXAMPLE 5

Inventive Embodiment Example 11 is essentially repeated, but no hydroxylpropyl cellulose with a molecular weight of 850,000 g/mol is used, but the viscosity is merely adjusted by adding DPM, the viscosity likewise being in the range of about 660 mPas. The viscosity properties are determined by a jump test, with oscillation initially for about 9 minutes and the oscillation interrupted for about 15 seconds with a shear rotation of 100 $s^{-1}$ and then oscillated again for about 4 minutes (20° C.). The tan (delta) G2/G1 after about 4 minutes is about 4.5. The color paste is transferred to a substrate by means of the printing process described above and cured. The printed substrate now shows a very clear satellite formation.

INVENTIVE EMBODIMENT EXAMPLE 13

100 parts by weight of a color paste from Ferro GmbH based on the glass color powder 14316 and the medium C7 (both Ferro GmbH) is mixed with Dowanol DPM (8, 1 parts by weight) and 8 parts by weight of a solution of a hydroxylpropyl cellulose with a molecular weight of 370,000 g/mol in DPM (7.2 parts by weight of polymer in 200 parts by weight of DPM) Set viscosity of about 990 mPas, measured at 20° C. and a shear rate of 200/sec, the concentration of this active substance being about 0.25% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 1.9.

The color paste is transferred to a substrate by means of the printing process described above and cured. The printed substrate shows only very little satellite formation.

INVENTIVE EMBODIMENT EXAMPLE 14

100 parts by weight of a color paste from Ferro GmbH based on the Glass color powder 14316 and the medium C7 (both Ferro GmbH) is mixed with Dowanol DPM (10.3 parts by weight) and 8 parts by weight of a solution of a hydroxylpropyl cellulose with a molecular weight of 850,000 g/mol in DPM (3.6 parts by weight of polymer in 200 parts by weight of DPM) to adjust the viscosity to about 600 mPas, measured at 20° C. and a shear rate of 200/sec, the concentration of this active substance being about 0.12% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4.3 minutes is about 2.2.

The color paste is transferred to a substrate by means of the printing process described above and cured. The printed substrate shows only very little satellite formation.

INVENTIVE EMBODIMENT EXAMPLE 15

100 parts by weight of a color paste from Ferro GmbH based on the glass paint powder 14316 and the medium C7 (both Ferro GmbH) is mixed with Dowanol DPM (7.5 parts by weight) and 8 parts by weight of a solution of a hydroxypropyl cellulose with a molecular weight of 850,000 g/mol in DPM (3.6 parts by weight of polymer in 200 parts by weight of DPM) to adjust the viscosity to about 1080 mPas, measured at 20° C. and a shear rate of 200/sec, the concentration of this active substance being about 0.12% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 2.1.

The color paste is transferred to a substrate by means of the printing process described above and cured. The printed substrate shows only very little satellite formation.

COMPARATIVE EXAMPLE 6

Inventive Embodiment Example 13 is essentially repeated, but no hydroxypropyl cellulose with a molecular weight of 370,000 g/mol is used, but rather the viscosity is only adjusted by adding DPM, the viscosity also being in the range of about 1100 mPas.

The viscosity properties are determined by a jump test, with oscillation initially for about 9 minutes and the oscillation interrupted for about 15 seconds by a shear rotation at 100 $s^{-1}$ and then oscillated again for about 4 minutes (20° C.). The tan (delta) G2/G1 after about 4 minutes is about 4.0.

The color paste is transferred to a substrate by means of the printing process described above and cured. The printed substrate now shows a very clear satellite formation.

COMPARATIVE EXAMPLE 7

Inventive Embodiment Example 14 is essentially repeated, but no hydroxylpropyl cellulose with a molecular weight of 850,000 g/mol is used, but the viscosity is only adjusted by adding DPM, the viscosity also being in the range of about 500 mPas.

The viscosity properties are determined by a jump test, with oscillation initially taking place for about 9 minutes, the oscillation being interrupted for about 15 seconds by a shear rotation at 100 $s^{-1}$ and then oscillating again for about 4 minutes (20° C.) tan (delta) G2/G1 after about 4 minutes is about 5.1.

The color paste is transferred to a substrate by means of the printing process described above and cured. The printed substrate now shows a very clear satellite formation.

INVENTIVE EMBODIMENT EXAMPLE 16

100 parts by weight of a color paste from Ferro GmbH based on the glass color powder 14501 and the medium C7 (both Ferro GmbH) is mixed with Dowanol DPM (9.5 parts by weight) and 8 parts by weight of a solution of a hydroxylpropyl cellulose with a molecular weight of 370, 000 g/mol in DPM (7.2 parts by weight of polymer in 200 parts by weight of DPM) Set viscosity of about 1010 mPas, measured at 20° C. and a shear rate of 200/sec, the concentration of this active substance being about 0.24% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 1.9. The color paste is transferred to a substrate using the printing process described above and cured. The printed substrate shows only very little satellite formation.

INVENTIVE EMBODIMENT EXAMPLE 17

100 parts by weight of a color paste from Ferro GmbH based on the glass paint powder 14501 and the medium C7 (both Ferro GmbH) is mixed with Dowanol DPM (12, 1 parts by weight) and 8 parts by weight of a solution of a hydroxylpropyl cellulose with a molecular weight of 370, 000 g/mol in DPM (7.2 parts by weight of polymer in 200 parts by weight of DPM) to adjust the viscosity to about 640 mPas, measured at 20° C. and a shear rate of 200/sec, the concentration of this active substance being about 0.24% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 1.5.

The color paste is transferred to a substrate by means of the printing process described above and cured. The printed substrate shows only very little satellite formation.

INVENTIVE EMBODIMENT EXAMPLE 18

100 parts by weight of a color paste from Ferro GmbH based on the glass color powder 14501 and the medium C7 (both Ferro GmbH) is mixed with Dowanol DPM (12.5 parts by weight) and 8 parts by weight of a solution of a hydroxylpropyl cellulose with a molecular weight of 850, 000 g/mol in DPM (3.6 parts by weight of polymer in 200 parts by weight of DPM) to adjust the viscosity to about 540 mPas, measured at 20° C. and a shear rate of 200/sec, the concentration of this active substance being about 0.12% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 0.4.

The color paste is transferred to a substrate by means of the printing process described above and cured. The printed substrate shows only very little satellite formation.

INVENTIVE EMBODIMENT EXAMPLE 19

100 parts by weight of a color paste from Ferro GmbH based on the glass color powder 14501 and the medium C7 (both Ferro GmbH) is mixed with Dowanol DPM (9.4 parts by weight) and 8 parts by weight of a solution of a hydroxylpropyl cellulose with a molecular weight of 850, 000 g/mol in DPM (3.6 parts by weight of polymer in 200 parts by weight of DPM) to adjust the viscosity to about 1040 mPas measured at 20° C. and a shear rate of 200/sec, the concentration of this active substance being about 0.12% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 2.2.

The color paste is transferred to a substrate by means of the printing process described above and cured. The printed substrate shows only very little satellite formation.

COMPARATIVE EXAMPLE 8

Inventive Embodiment Example 18 is essentially repeated, but no hydroxypropyl cellulose with a molecular weight of 850,000 g/mol is used, but rather the viscosity is only adjusted by adding DPM, the viscosity likewise being in the range of about 480 mPas.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 5.9.

The color paste is transferred to a substrate by means of the printing process described above and cured. The printed substrate now shows a very clear satellite formation.

COMPARATIVE EXAMPLE 9

Inventive Embodiment Example 19 is essentially repeated, but no hydroxypropyl cellulose with a molecular weight of 850,000 g/mol is used, but the viscosity is merely adjusted by adding DPM, the viscosity likewise being in the range of about 1060 mPas.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 5.6.

The color paste is transferred to a substrate by means of the printing process described above and cured. The printed substrate now shows a very clear satellite formation.

INVENTIVE EMBODIMENT EXAMPLE 20

100 parts by weight of color paste from Ferro GmbH based on the glass color powder 14510 and the medium C7 (both Ferro GmbH) is mixed with Dowanol DPM (10.0 parts by weight) and 5 parts by weight of a solution of a hydroxylpropyl cellulose with a molecular weight of 370, 000 g/mol in DPM (7.2 parts by weight of polymer in 200 parts by weight of DPM) to adjust the viscosity to about 1010 mPas, measured at 20° C. and a shear rate of 200/sec, the concentration of this active substance being about 0.16% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 1.9.

The color paste is transferred to a substrate by means of the printing process described above and cured. The printed substrate shows only very little satellite formation.

INVENTIVE EMBODIMENT EXAMPLE 21

100 parts by weight of a color paste from Ferro GmbH based on the glass color powder 14510 and the medium C7 (both Ferro GmbH) is mixed with Dowanol DPM (12.8 parts by weight) and 5 parts by weight of a solution of a hydroxylpropyl cellulose with a molecular weight of 370, 000 g/mol in DPM (7.2 parts by weight of polymer in 200 parts by weight of DPM) to adjust the viscosity to about 580 mPas, measured at 20° C. and a shear rate of 200/sec, the concentration of this active substance being about 0.15% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 2.0.

The color paste is transferred to a substrate by means of the printing process described above and cured. The printed substrate shows only very little satellite formation.

INVENTIVE EMBODIMENT EXAMPLE 22

100 parts by weight of a color paste from Ferro GmbH based on the glass color powder 14510 and the medium C7 (both Ferro GmbH) is mixed with Dowanol DPM (12.5 parts by weight) and 5 parts by weight of a solution of a hydroxylpropyl cellulose with a molecular weight of 850, 000 g/mol in DPM (3.6 parts by weight of polymer in 200 parts by weight of DPM) to adjust the viscosity to about 600 mPas, measured at 20° C. and a shear rate of 200/sec, the concentration of this active substance being about 0.08% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 1.5.

The color paste is transferred to a substrate by means of the printing process described above and cured. The printed substrate shows only very little satellite formation.

INVENTIVE EMBODIMENT EXAMPLE 23

100 parts by weight of a color paste from Ferro GmbH based on the glass color powder 14510 and the medium C7 (both Ferro GmbH) is mixed with Dowanol DPM (10.0 parts by weight) and 5 parts by weight of a solution of a hydroxylpropyl cellulose with a molecular weight of 850, 000 g/mol in DPM (3.6 parts by weight of polymer in 200 parts by weight of DPM) to adjust the viscosity to about 970 mPas, measured at 20° C. and a shear rate of 200/sec, the concentration of this active substance being about 0.08% by weight.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 2.1.

The color paste is transferred to a substrate by means of the printing process described above and cured. The printed substrate shows only very little satellite formation.

COMPARATIVE EXAMPLE 10

Inventive Embodiment Example 22 is essentially repeated, but no hydroxypropyl cellulose with a molecular weight of 850,000 g/mol is used, but rather the viscosity is only adjusted by adding DPM, the viscosity likewise being in the range of about 530 mPas.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 6.2.

The color paste is transferred to a substrate by means of the printing process described above and cured. The printed substrate now shows a very clear satellite formation.

COMPARATIVE EXAMPLE 11

The embodiment 23 is essentially repeated, but no hydroxylpropyl cellulose with a molecular weight of 850, 000 g/mol is used, but the viscosity is only adjusted by adding DPM, the viscosity also being in the range of about 970 mPas.

The viscosity properties are determined by a jump test, with oscillation initially for about 9 minutes, the oscillation being interrupted for about 15 seconds by a shear rotation at 100 $s^{-1}$ and then oscillating again for about 4 minutes (20° C.). The tan (delta) G2/G1 after about 4 minutes is about 4.0.

The color paste is transferred to a substrate by means of the printing process described above and cured. The printed substrate now shows a very clear satellite formation.

INVENTIVE EMBODIMENT EXAMPLE 24

100 parts by weight of a color paste from Ferro GmbH based on the Glass paint powder 14510 and the medium C7 (both Ferro GmbH) is mixed with Dowanol DPM (10.0 parts by weight) and 5 parts by weight of a solution of a hydroxylethyl cellulose with a molecular weight of 420,000 g/mol in DPM (7 parts by weight of polymer in 100 parts by weight of DPM) to a viscosity of set about 1000 mPas, measured at 20° C. and a shear rate of 200/sec.

The examples show that the objects set out above can be achieved by the present invention, in particular the formation of satellites can surprisingly be significantly reduced without adversely affecting other properties of the printing substance.

The invention claimed is:

1. A printing method for the transfer of a printing substance from an ink carrier to a substrate, the method comprising:

emitting energy from an energy-emitting device, and changing a volume and/or position of the printing substance using energy emitted from an energy-emitting device, wherein the energy comprises electromagnetic waves, wherein the printing substance comprises a high molecular weight binder having a weight average molecular weight of 100,000-10,000,000 q/mol measured by means of GPC, and a distance between the printing substance and the substrate is 50 μm to 450 μm.

2. The printing method according to claim 1, wherein the energy is transferred from the electromagnetic wave into the printing substance using absorption bodies.

3. The printing method according to claim 1, wherein the printing substance comprises 0.01-5 wt.-% of the high molecular weight binder.

4. The printing method according to claim 1, wherein the printing substance has a ratio of loss modulus (G2) to storage modulus (G1) [tan (delta)=G2/ G1] ranging from 0.05 to 1.3.

5. The printing method according claim 1, wherein the printing substance comprises absorption bodies, the absorption bodies comprising carbon black or at least one inorganic pigment.

6. The printing substance for carrying out the printing process according to claim 1, the printing substance further comprising:

at least one low molecular weight binder, and at least one functional carrier.

7. The printing substance according to claim 6, wherein the at least one functional carrier is selected from the group consisting of inorganic pigments, glass fluxes, and metal particles.

8. The printing substance according to claim 7, wherein the metal particles comprise silver particles.

9. The printing substance according to claim 6, wherein the printing substance has a viscosity of 400-4500 mPas measured at 20° C. at a shear rate of 2 $s^{-1}$, measured with a plate/cone.

10. The printing substance according to claim 9, wherein the viscosity of the printing substance is within the range of 1000-2000 mPas, when measured at 20° C. and a shear of 2 $s^{-1}$ with plate/cone.

11. The printing substance according to claim 9, wherein the viscosity of the printing substance is within the range of 500-1000 mPas, when measured at 20° C. and a shear of 200 $s^{-1}$ with plate/cone.

12. The printing substance according to claim 9, wherein the viscosity of the printing substance is within the range of 400-800 mPas, when measured at 20° C. and a shear of 600 $s^{-1}$ with plate/cone.

13. The printing substance according to claim 6, wherein the printing substance comprises at least one propellant with a boiling point ranging from 60° C. to 250° C.

14. The printing substance according to claim 6, wherein a weight average molecular weight (Mw) of the at least one low molecular weight binder ranges from 10,000 to 150,000 g/mol, when measured according to GPC.

15. The printing substance according to claim 6, wherein the surface tension of the printing substance is 26-34 mN/m.

16. The printing substance according to claim 6, wherein the at least one functional carrier comprises particles with a d50 of 0.5-30 μm.

17. The printing substance according to claim 6, wherein a solid content of the printing substance is at least 30% by weight.

18. The printing method according to claim 1, wherein the substrate is selected from the group consisting of glass, ceramic, metal, wood and plastic; and the printing substance further comprises:

at least one low molecular weight binder, and at least one functional carrier.

19. The printing method according to claim 1, further comprising:

applying the printing substance to the substrate, wherein the substrate is selected from the group consisting of glass, ceramic, metal, wood and plastic.

20. The printing method according to claim 19, further comprising:

curing the printing substance on the substrate, wherein a curing temperature ranges from 150° C. to 1200° C.

* * * * *